United States Patent [19]

Mathews et al.

[11] Patent Number: 4,635,654

[45] Date of Patent: Jan. 13, 1987

[54] METHOD FOR EVALUATING EFFICACY OF A HAIR STYLING PRODUCT

[75] Inventors: Roger A. Mathews, Newbury Park; David W. Cannell, Los Angeles, both of Calif.

[73] Assignee: Redken Laboratories, Inc., Canoga Park, Calif.

[21] Appl. No.: 794,740

[22] Filed: Nov. 4, 1985

[51] Int. Cl.[4] ..... A45D 7/00

[52] U.S. Cl. ..... 132/7

[58] Field of Search ..... 132/7

[56] References Cited

U.S. PATENT DOCUMENTS 2,808,838 10/1957 Stageberg ..... 132/7
2,836,185 5/1958 Hervey ..... 132/7
3,242,052 3/1966 Sheffner ..... 132/7
3,250,682 5/1966 Wilmsmann et al. ..... 132/7

*Primary Examiner*—Gregory E. McNeill
*Attorney, Agent, or Firm*—Christie, Parker & Hale

[57] ABSTRACT

The ability of a hair styling material to enhance the holding power of a curl is determined by a comparison with the holding power of hair set only with water. A tress of hair is wetted and wrapped around a cylinder and held in place until dried. A similar curled tress is treated with a hair styling material. Each of the tresses is compressed across a diameter and the force and deflection are measured. The work of deformation of the treated loop of hair is compared with the work of deformation of the water treated loop of hair by finding the ratio between the two works of deformation. This ratio is a "hold factor" for the hair styling material.

24 Claims, 4 Drawing Figures

Fig. 1
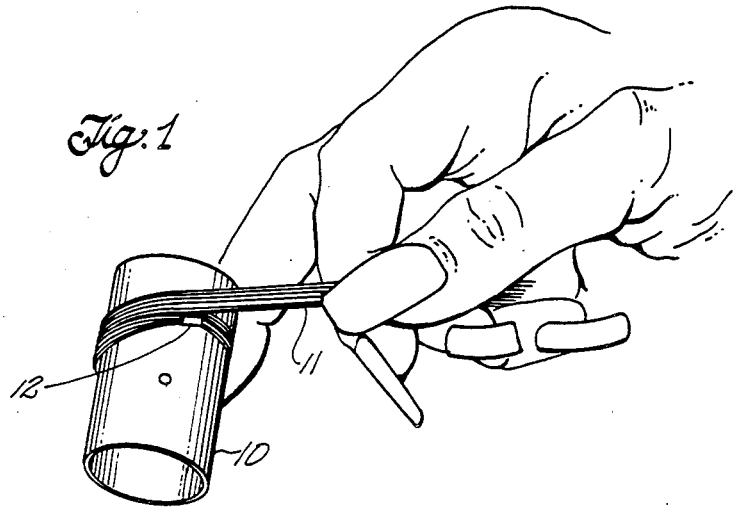
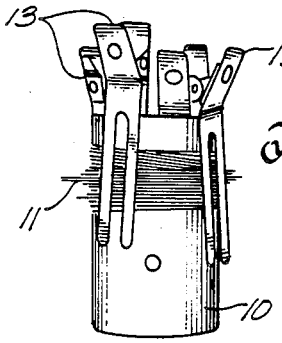
Fig. 2
Fig. 4
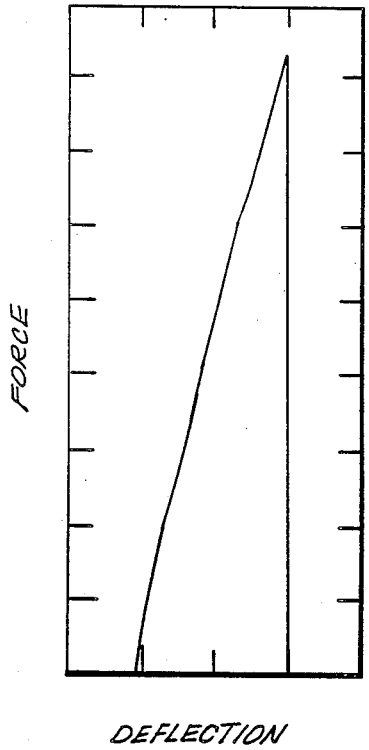
Fig. 3
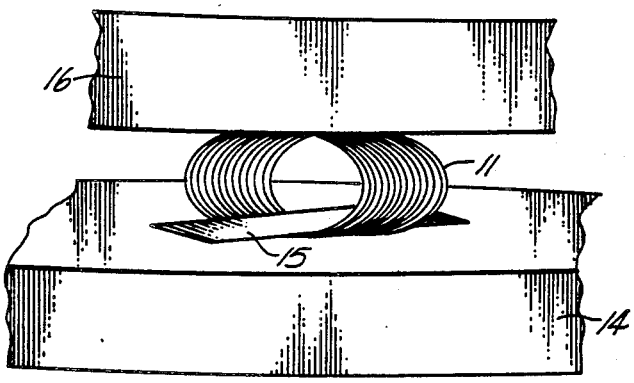

METHOD FOR EVALUATING EFFICACY OF A HAIR STYLING PRODUCT

BACKGROUND

Hair stylists apply various compositions to a person's hair to enable it to hold a setting when the styling is complete. Various compositions provide different abilities to hold a setting, and various compositions may be used on different types of hair to obtain a desired effect.

No one has previously developed a satisfactory quantitative technique for determining the "hold factor" or ability of a composition to hold a styling when used in a salon. The most satisfactory technique has relied on the skill and experience of the operators who can feel the effect of the composition when the styling is complete. Although this may be satisfactory for a salon setting so that the operator knows that the desired effect has been obtained, it is not sufficiently quantitative for development of new products and is too cumbersome for comparison of existing products. Further, the variability of hair makes comparison of tests almost infeasible because of absence of controls.

A variety of tests have been attempted but none have proved satisfactory for determining the holding efficacy of a variety of compositions. For example, tensile tests of single strands or tresses of hair do not correlate well with results obtained in a salon setting. It is therefore desirable to provide a simple, reliable, repeatable test for the holding ability of various compositions.

BRIEF SUMMARY OF THE INVENTION

There is, therefore, provided in practice of this invention according to a presently preferred embodiment a method for evaluating the efficacy of a hair styling product by forming a curled tress of hair treated with such a styling product and measuring the work of deformation of the curled tress. The work of deformation of the treated tress is compared with the work of deformation of a tress treated solely with water. This effectively cancels out the effect of water and hair assembly variables so that the styling product is evaluated for its own merit. By using samples of the same hair for both tests, a control is provided for comparison. In a preferred embodiment one determines the ratio of (a) the integral of the force required to deflect the treated curl times the distance the treated curl deflects and (b) the integral of force required to deflect a curl treated with water times the distance the water treated curl deflects, where the distance is the same in both cases.

DRAWINGS

These and other features and advantages of the present invention will be appreciated as the same becomes better understood by reference to the following detailed description when considered in connection with the accompanying drawings wherein:

FIG. 1 illustrates in perspective, winding of a loop of hair on a roller for evaluation in practice of this invention;

FIG. 2 illustrates the curl of hair clipped on the roller for drying;

FIG. 3 illustrates compression testing of the loop of hair; and

FIG. 4 illustrates an exemplary force-deflection curve obtained in such a compression test.

DESCRIPTION

It is well known that when hair is saturated or partly saturated with water, and curled or set to a desired style, it tends to retain that set when dried. It is believed that the setting of hair with water reorganizes the hydrogen bonding structures of the keratin proteins that make up the hair and thus facilitates the "hold" of the set.

There are a variety of chemical treatments, perms and reactive salon procedures that can also be practiced. It is believed that these reorganize the ionic and covalent bonding structures of the proteins making up the hair. These effects are superimposed on the reorganization of the hydrogen bonding structures.

Further, there are interactions between the hair fibers which can affect the ability of the hair to hold a set. There is inter-fiber friction which may be modified by various substances deposited on the hair such as resins, polymers, and the like. For example, microscopic inspection of an assemblage of hair treated with a hair spray shows evidence of interfibrilar "spot welds" or "coatings" which increase the tendency of adjacent fibers to interact or cause a splint or buttress such that many fibers support one another. These effects are also superimposed on the hold due to water alone.

To evaluate compositions that modify the ionic or covalent bonding of the hair, or are deposited on the hair to change interfibrilar effects, it is desirable to "cancel out" the effect of the water mediated hold.

It is also apparent that human hair is quite individualistic and different types of hair have quite different properties. The differences are often due to the natural quality of the hair. They may also be due to prior chemical treatments. For example, bleached hair behaves differently from unbleached hair. Thus, if the effect of the water mediated set of the hair is to be cancelled, control tests should be made using the same hair samples as the material to be tested.

In the method provided in practice of this invention, tresses of hair weighing 0.5 grams are used. An exemplary tress is about 21 centimeters long with some hairs being longer and others shorter, as is customary in human hair samples. Each test of a styling composition is compared with a control using tresses of the same hair. It is desirable to run each test and control in triplicate to minimize the effect of scatter and clearly exclude anomalous tests, hence six tresses are used and a total of three grams of each hair sample is required.

The strands in each tress of hair are clipped together near one end (about two centimeters from the end) with a stainless steel band. The clipped tress is prepared for testing by washing the hair in a detergent solution, rinsing thoroughly, and allowing the hair to dry completely at room temperature.

The tresses are prepared for testing by leaving the hair tress in water at room temperature for about thirty minutes to saturate the hair. The tress is then manually wrapped like a ribbon around a 2.8 centimeter outside diameter plastic salon hairstyling roller 10 as illustrated in FIG. 1. The end of the tress 11 having the clip 12 is placed against the roller and the ribbon of hair is wrapped around the roller to overlap the clipped end and form a loop of hair around the roller. An exemplary tress makes a little more than two full revolutions around the roller. The curled or coiled tress is held in place by four standard salon clips 13 as illustrated in FIG. 2. The coiled and clipped tress is then dried on the roller at 50° C. for one hour in an oven that permits gravity circulation of air for thoroughly drying the tresses. All hair samples tested are wrapped around a roller in exactly the same manner as the water saturated control samples.

To evaluate the effect of various raw materials such as resins, or finished styling preparations, a water saturated tress is treated with a constant amount of the test material. Preferably about 0.5 grams of the test composition is applied to each tress, either before or after wrapping the tress around a roller. For example, a test composition may be a solution of up to 1% polyvinylpyrrolidone in water. One-half milliliter of solution is applied from a pipette in drops around the coiled tress on the roller.

In a given test regimen, six substantially identical hair tresses are treated in this manner. Three water saturated tresses are wrapped and dried to serve as controls. Three tresses also treated with the test composition are wrapped and dried in the same manner. This results in six curved swatches or loops of hair whose inside diameter corresponds to the outside diameter of the plastic roller.

The work of deformation of the loop of hair is determined by a compression test. The testing machine should measure the force required to deflect the loop of hair as a function of distance. Force times distance is a measure of the work required to deform the loop. A standard Instron tensile tester is satisfactory for this purpose.

The hair sample 11 is placed upright on the lower anvil 14 of the tester with the band at one end of the tress being at the bottom. A small piece of transparent tape 15 or the like is placed through the loop and secured to the anvil to hold the loop upright as can be seen in FIG. 3. The movable head 16 of the testing machine is then brought down against the loop of hair and force is applied to deform the curl from its original circular cross section toward an oval cross section. Force is applied at a constant rate of increase until a selected magnitude of deflection is reached, at which time force and deflection are released. In a typical test the loop of hair is deformed so that the minor axis of the deformed loop is about one-half the diameter of the originally circular loop. All six tresses in a given test are tested at the same rate and to the same maximum.

Deflection and force are recorded on a strip chart recorder to yield a stress-strain curve such as the exemplary graph illustrated in FIG. 4. The illustrated curve is representative of a relatively stiff tress, and a softer tress would have a less steep increase in force. The amount of work done to deform the test specimen is proportional to the area under such a curve. This area is integrated to find the work. This can be done with a planimeter or, as has been found quite convenient, the area encompassed by the curve is cut out of the strip chart with scissors and weighed. The weight is proportional to the area under the stress-strain curve, which is proportional to the work required to depress the loop of hair.

The work of deformation determined by the three control tests is averaged, as are the results of the three tests of hair treated with the composition under evaluation. The "hold factor" is calculated by determining the ratio of the average work of compression of the three samples treated with a styling composition and the three samples of the water set control. The ratio of the work required to compress a treated sample to the work required to compress a sample treated only with water effectively cancels out the effect of the set mediated by water.

The hold factor, or ratio of works required to deform the two types of specimens, provides a good measure of the ability of the styling composition to hold a set in a salon environment. The hold factor is generally in the range of from about 2 to 20; that is, the work done in deforming a treated specimen is from 2 to 20 times the work to deform a like specimen treated only with water. Hold factors as high as 40 have been observed. Products having hold factor tests as high as 30 may have cosmetic applications, however, most products that are marketed have hold factors up to about 20.

The test has been validated with a variety of compositions. As one example, solutions of 0.25%, 0.5%, 0.75% and 1.0% polyvinylpyrrolidone (PVP) in water were tested. The hold factor increases linearly with PVP concentration up to about 1% by weight, where the hold factor is about 4.

In another group of tests the hold factor for another common ingredient in hair styling compositions was measured. Solutions were made of PVP/VAE in water in concentrations up to 1.5%. PVP/VAE is a copolymer of PVP and a vinyl acetate ester. The hold factor increased linearly to about hold factor 7.4 at the highest concentration.

More complex mixtures with various solvents, polymers, and other additives may modify the hair/resin interactions and tests of completed formulations are desirable even though the hold factors of individual ingredients are known. For example, a styling mousse was prepared with concentrations of Amersette, a commonly used proprietary hair styling ingredient, from 1.5% to 3.0%. The hold factor increased linearly with concentration in this complex mixture.

The tests show good reproducibility for a material as variable as hair. Twenty-six water set control tests (each in triplicate) were analyzed and the average deviation was about 10%. Similarly eighty triplicate tests of a variety of products were analyzed and the average deviation was about 14%. Variations in the measured values for work of deformation tend to increase with compositions that produce stiffer test specimens. Thus, when the hold factor is high, deviation may increase but is ordinarily less than 20%. The increase may be due to increased sensitivity to variations in application of the composition to the tresses. If greater precision is required, additional replications of the test specimens, or tests on other samples of hair can be averaged, to enhance confidence in the test results. This may be desirable for styling foams, for example, where variability in the order of 25% is sometimes observed. The variation in hold factor observed with commercial products is likely the result of uneven distribution of foams or highly viscous products on the hair prior to loop forming and drying.

It is found that the test of a loop of hair where the work used to depress the loop is measured, has good correlation with the tactile perceptions of the hair stylist. Stylists commonly evaluate the ability of the hair to hold a setting by the feel of the styled hair. An experienced operator evaluates the "crispness" of the hair by pressing on it.

Even a skilled operator does not provide as sensitive a measure of the work of deformation as the described test. A skilled operator can scarcely distinguish compositions with hold factors in the range of from 6 to 8, for example, whereas the test readily distinguishes such compositions. Thus, the test somewhat simulates what is done in the styling salon when the operator "scrunches" the hair. The test is, however, substantially more sensitive than the subjective probing by a salon operator. Measuring the work of deformation of a curled tress of hair, with cancellation of the effect of a water set, provides an excellent objective way of evaluating existing cosmetic compositions and new compositions to be developed for the styling market. It is much quicker and less expensive than testing new compositions in the field.

It will be apparent that modifications and variations can be made in the method for evaluating hair styling products provided in practice of this invention. An embodiment has been described with a selected weight and length of hair and selected quantity of test material. Clearly these can be varied as desired for a particular embodiment. About all that is needed is that the hair used for the control be similar to the hair used for a given test.

It will also be apparent that instead of the control having only a water set, one may, if desired, employ a control having additional reactive treatment for better evaluating the effect of combined treatments with complex compositions.

Instead of measuring the area under the curve directly to determine the work of deformation, one may simply measure the slope of the line representing increasing force as a function of displacement when such a line is substantially linear. Similarly, the product of the coordinates of a reference point (such as a given force or given deflection) also serves as a measure of the work when deformation is approximately linear. In other words, the work of deformation is proportional to the elastic modulus of deformation of a curl when linear. Integrating the area under the curve is considered preferable since this readily accounts for nonlinearities as may occur with a curved composite specimen of the nature tested in practice of this invention.

No substantial effect of ambient conditions at the time of testing have been observed, since tests are typically conducted in an air conditioned laboratory and the controls and test samples are all compression tested in a relatively short interval. If desired, tests of treated loops of hair and untreated control loops of hair can be alternated for minimizing the effect of changing conditions. Likewise, if desired, tests can be conducted in an environmental control chamber with constant humidity and temperature. No need for this sophistication has yet been observed for routine testing. If it is desired to test the efficacy of a material that lends droop resistance to hair, tests at various humidity levels can be performed.

Many other modifications and variations of a test where the work of deformation of a treated tress is compared with the work of deformation of a control for evaluating efficacy of hair styling products will be apparent to one skilled in the art. It is therefore to be understood that within the scope of the appended claims, the invention may be practiced otherwise than as specifically described.

What is claimed is:

1. A method of evaluating efficacy of a hair styling product comprising:

forming a coiled tress of hair treated with such a hair styling product;

measuring the work of deformation of the coiled treated tress; and comparing the work of deformation of the coiled treated tress with the work of deformation of a coiled tress treated with water.

2. A method as recited in claim 1 wherein the step of forming a coiled tress comprises saturating the tress with water, wrapping the tress around a cylinder, and drying the tress on the cylinder.

3. A method as recited in claim 2 wherein the coiled tress is treated with a hair styling product after wrapping around the cylinder.

4. A method as recited in claim 2 wherein the coiled tress treated with water is formed in the same way as the coiled treated tress.

5. A method as recited in claim 1 wherein the work of deformation is measured by compressing a diameter of such a coiled tress.

6. A method as recited in claim 5 wherein the work of deformation is measured by the product of deflection of the coiled tress times the force used to deflect the tress.

7. A method as recited in claim 5 wherein the comparing step comprises determining a hold factor as the ratio of the work of deformation of a coiled treated tress and the work of deformation of a coiled tress treated with water.

8. A method as recited in claim 1 wherein the comparing step comprises determining a hold factor as the ratio of the work of deformation of a coiled treated tress and the work of deformation of a coiled tress treated with water.

9. A method as recited in claim 1 wherein the comparing step comprises determining the ratio of the area under a stress-strain curve of a coiled treated tress and the area under a stress-strain curve of a coiled tress treated with water.

10. A method as recited in claim 9 wherein such a stress-strain curve is obtained by compressing such a coiled tress across a diameter.

11. A method for evaluating holding ability of a hair styling material comprising the steps of:

saturating at least a pair of tresses of the same hair with water;

wrapping each of the tresses of hair around a cylinder for forming a loop of hair;

treating at least one of such tresses with such a hair styling material;

drying such loops of hair;

compressing each of such loops of hair across a diameter; and comparing compression of at least one of such treated loops with compression of at least one of the other loops for evaluating enhanced ability of such a treated loop to resist deformation.

12. A method as recited in claim 11 wherein such a tress is treated with hair styling material before wrapping around a cylinder.

13. A method as recited in claim 11 wherein the comparing step comprises comparing the area under a stress-strain curve for at least one such treated loop with an area under a stress-strain curve for at least one such other loop.

14. A method as recited in claim 11 wherein the comparing step comprises comparing the work of deformation of at least one such treated loop with the work of deformation of at least one such other loop.

15. A method as recited in claim 11 wherein the comparing step comprises the steps of:

(a) finding the product of deformation force times deformation distance for at least one such treated loop;

(b) finding the product of deformation force times deformation distance for at least one such other loop; and determining the ratio of the findings of steps (a) and (b).

16. A method for evaluating efficacy of a hair styling product comprising the steps of:

forming a tress of hair treated with such a hair styling product into a loop;

drying the treated loop of hair;

compressing the treated loop of hair across a diameter;

integrating the force required to deflect the treated loop times the distance the treated loop deflects;

forming a tress of the same hair wetted with water into a loop;

drying the wetted loop of hair;

compressing the water wetted and dried loop of hair across a diameter;

integrating the force required to deflect the water wetted and dried loop times the distance the water wetted and dried loop deflects; and determining the ratio of products of the two integration steps.

17. A method as recited in claim 16 wherein the treated hair is also wetted with water.

18. A method as recited in claim 17 wherein the tress is treated with the hair styling product after forming the loop.

19. A method as recited in claim 17 wherein each loop formed by wrapping the water wetted tress around a cylinder and the tress is dried on the cylinder.

20. A method as recited in claim 16 wherein each integrating step comprises graphing deflection force as a function of deflection distance and determining the area of the graph.

21. A method for evaluating holding ability of a hair styling material comprising the steps of:

treating a tress of hair with a hair styling material;

wrapping the tress of hair around a cylinder for forming a coil of hair;

drying the coil of hair;

compressing the coil of hair across a diameter; and measuring resistance to compression of the treated coil.

22. A method as recited in claim 21 wherein the tress of hair is treated with hair styling material after wrapping around the cylinder.

23. A method as recited in claim 21 wherein the measuring step comprises measuring the area under a stress-strain curve for the treated loop of hair.

24. A method as recited in claim 21 wherein the measuring step comprises measuring the work of deformation of the treated loop of hair.

* * * * *